United States Patent [19]

Bryan

[11] Patent Number: 4,955,151

[45] Date of Patent: Sep. 11, 1990

[54] BUCKET WHEEL WITH OVERHEAD DISCHARGE

[75] Inventor: John F. Bryan, Dallas, Tex.

[73] Assignee: Krupp Industrietechnik GmbH, Duisburg, Fed. Rep. of Germany

[21] Appl. No.: 327,713

[22] Filed: Mar. 23, 1989

[51] Int. Cl.[5] ..... E02F 3/24

[52] U.S. Cl. ..... 37/190; 198/705; 37/93

[58] Field of Search ..... 37/70, 83, 86, 87, 91, 37/94, 95, 97, 189, 190; 198/703, 704, 705

[56] References Cited

U.S. PATENT DOCUMENTS

| | | | |
|---|---|---|---|
| 3,897,109 | 7/1975 | Satterwhite . | |
| 4,069,605 | 1/1978 | Satterwhite | 37/190. |
| 4,155,181 | 5/1979 | Satterwhite | 37/190 |
| 4,156,977 | 6/1979 | Satterwhite | 37/190 |
| 4,157,623 | 6/1979 | Satterwhite | 37/190 |
| 4,162,584 | 7/1979 | Satterwhite | 37/190 |
| 4,180,927 | 1/1980 | Satterwhite | 37/190 |
| 4,197,662 | 4/1980 | McAulay et al. . | |

*Primary Examiner*—Dennis L. Taylor
*Assistant Examiner*—J. Russell McBee
*Attorney, Agent, or Firm*—Spencer & Frank

[57] ABSTRACT

An excavating bucket wheel has a plurality of radially outwardly open bucket chambers disposed in a circular array. During rotation of the bucket wheel each chamber cyclically assumes a material receiving position and a material dumping position. Each bucket chamber is defined by a cutting plate supported at the wheel periphery and having a trailing edge as viewed in the direction of wheel rotation, two axially spaced, parallel side walls and a rear wall extending axially between the side walls. An outer edge of the rear wall is situated adjacent the cutting plate. Each bucket chamber is further defined by a bottom wall extending axially between the side walls and being supported for pivotal motion about an axis oriented parallel to the rotary axis of the bucket wheel and situated adjacent the outer wheel periphery. The bottom wall has a first pivotal position for receiving material and a second pivotal position for dumping material. There is further provided a first actuating device for pivoting the bottom wall. Each rear wall is, at an inner edge thereof, supported for pivotal motion about an axis oriented parallel with the rotary axis of the bucket wheel. A second actuating device urges each rear wall into contact with the outer terminal edge of a respective bottom wall.

12 Claims, 2 Drawing Sheets

3
1
2
11
7
12
8
9
10
14
13
6
13
15
5
5'

8
19
35'
21'
17'
19
13
14
18'
18'
32
34
30
35'
32
20'
31
31
33
33
32
17'
19
20'
34
33
30
14
38
20'
13
28
5'
33
35'
27
41
20'
31
10
16'
5
29
26
19
15'
16'
6'
7

BUCKET WHEEL WITH OVERHEAD DISCHARGE

BACKGROUND OF THE INVENTION

The invention relates to an overhead discharge bucket wheel for a frontal digging (excavating) system including at least one bucket wheel and devices for receiving and transporting the removed material. The bucket wheel, which is mounted on a travelling chassis, has buckets each having a chamber defined by portions of two parallel, disc-like side walls, a rear wall, whose outer end adjoins a cutting plate and a bottom wall which extends between the side walls. The bottom is pivotal, between a receiving and a discharge (dumping) position, about a shaft oriented parallel to the rotary shaft of the bucket wheel and situated in the vicinity of the circumference of the bucket wheel and the rear wall of the adjoining bucket. In the discharge position the free edge of the bottom lies against the rear wall of the bucket.

A frontal digging system of the above-outlined type disclosed, for example, in U.S. Pat. No. 3,897,109, can be employed to load the bulk material and, in particular, to strip even relatively hard rock layers. The system includes coaxially arranged bucket wheels mounted on an outrigger fastened to the front of a vehicle frame. During forward travel, the bucket wheels receive material which they excavated or scooped up and dump the material overhead onto a conveyor belt system. Excavation of the material is possible in either one of the two opposite directions of bucket wheel rotation, that is, in an upward cut in which the material is lifted and in a downward cut.

The various embodiments of the bucket wheels of the known frontal digging system all have the drawback that, when the bottom of a bucket is in a discharge position in which the outer free edge of the bucket bottom is disposed approximately in a corner formed between the rear bucket wall and the cutting plate of the bucket, a pocket is formed in that region in which material, particularly material that tends to cake together, is retained so that the bucket does not completely empty.

SUMMARY OF THE INVENTION

It is an object of the invention to improve a bucket wheel in such a manner that complete emptying of the buckets is ensured, even for material that tends to cake.

This object and others to become apparent as the specification progresses, are accomplished by the invention, according to which, briefly stated, the rear wall of each bucket is pivotal about an axis parallel with the rotary axis of the bucket wheel and is provided with a drive means which causes the rear wall to lie against a free outer edge of the bottom of the bucket.

It is an important advantage of the invention that in the discharge position, the bucket bottom can be pivoted further outwardly, whereby the formation of a pocket in the region of the cutting plate is avoided in the outwardly pivoted (dumping) position.

Contrary to conventional bucket wheels in which each bucket rear wall is rigidly arranged in a defined position and must have an arcuate shape, the bucket wheels of the invention make it possible for the bucket bottom and the bucket rear wall to have different configurations to adapt them to different requirements for the use of the bucket wheel. The space available in the region of a bucket may be better utilized by appropriate configuration of the bucket chamber formed by bottom, rear wall and cutting plate. In particular, it is also possible to take into consideration the differences involved with changes in the direction of rotation of the bucket wheel and also with a change in the number of buckets. Since by virtue of an appropriate shaping of the buckets primarily the degree of fill of the buckets in operation is improved, it is possible not only to realize a greater usable load volume but also, compared to the prior art bucket wheels of this type, to realize primarily a more uniform flow of material, since unavoidable fluctuations in the degree of fill for certain types of material are considerably reduced.

The freedom (versatility) of shaping is particularly applicable for the cutting plates which may be flatter, that is, they may be arranged at a smaller angle in the circumferential direction, and may also be longer. This is particularly advantageous for excavating extremely thin layers which is required in many cases.

Reliable discharge of the material from the bucket wheel makes it possible to arrange a subsequent conveying device for receiving the material at a higher level, that is, at a greater distance from the ground.

It is another advantage of the invention that the bucket wheel can have a smaller diameter because the invention eliminates caking of the material at the inner cutting plates. Such a caking would be caused in conventional bucket wheels by the increased centrifugal forces generated by the increased rpm which must be set for bucket wheels of reduced diameter to maintain the circumferential velocity unchanged, that is, in an optimum range.

Furthermore, the bucket chamber configuration according to the invention may provide, if required, an effective seal between the bottom and the rear wall of each bucket chamber. Such a sealing contact can be obtained in a simple manner in that drive means for moving a rear wall is provided in the form of a spring element such as at least one compression spring. Or, pressurized cylinder units can be used to advantage, particularly if the bucket wheel is, in any event, provided with hydraulic or pneumatic connections for a hydraulic or pneumatic pressure medium. The cylinder pressure can be controlled to adapt it to various positions or operational states of the bucket wheel. The free outer bottom edges that contact the respective rear walls may be provided with a low-friction coating.

Independently of the driving means for the rear wall, each of the bucket bottoms may be movable by means of a transmission member which cooperates with an eccentric element disposed on the bucket wheel shaft. Suitable prior art devices, as disclosed, for example, in U.S. Pat. Nos. 3,897,109 or 4,197,662, can be used for this purpose.

In the alternative, the bucket bottoms may each be movable by means of a pressurized cylinder unit. Such an arrangement is advantageous in that the central interior of the bucket wheel may remain free (unoccupied) to accommodate other devices.

According to a preferred embodiment, linkages articulate each rear wall to the respective bottom to simultaneously constitute a drive (actuating) means for moving the rear walls so that a separate drive means is not required therefor. Preferably, an articulated end of the rear wall is provided with a lever which, at its free end, is hinged to a connecting member which, in turn, is articulated to the interior of the bucket bottom, thus making it possible to arrange the lever and the connecting member in a protected location inside the bucket bottom. Particularly favorable kinematic conditions result in this embodiment if the lever extends approximately parallel to the rear wall and the articulation of the connecting member to the bottom is disposed in such a manner that the axes of articulation of the connecting member and the pivotal axis of the bottom lie approximately in one plane when the bottom is in its outwardly-pivoted (dumping) position.

As a further feature of the invention, the rear wall in one of its two end positions, particularly in its material receiving position, lies against a final abutment. By virtue of such an arrangement, the weight derived from the filled bucket in the material receiving position can be transferred to the bucket wheel housing to thus relieve the rear wall. In the other end position of the rear wall where the bottom assumes the material discharging (dumping) position, a final abutment disposed, for example, at the cutting plate, may delimit the other end position of the rear wall so that, with separate drive means for the bottom and the rear wall, the bottom is able to move away from the rear wall and be pivoted further outwardly, thus enhancing discharge of material.

In a particularly simple and reliable embodiment of the invention, the transmission members comprise push rods which are of identical length and which are hinged endwise to the bottoms, with one end of each of the push rods connected at equal distances to a chain trained around an eccentric element. The chain links connected with the push rods may be designed such that the connecting hinge between push rod and chain is spaced essentially equidistantly from the exterior of the chain line, as disclosed and illustrated in U.S. Pat. No. 4,197,662.

Figure 1:
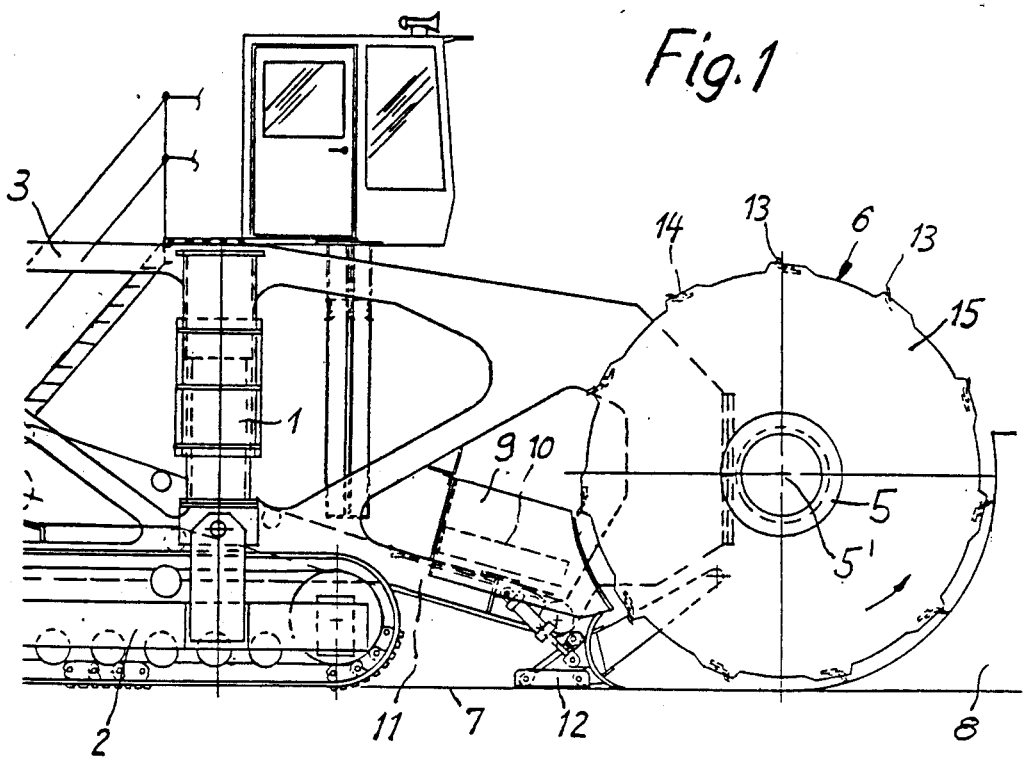
FIG. 1 is a schematic side elevational view of a travelling excavator having a bucket wheel incorporating the invention.

DESCRIPTION OF THE PREFERRED EMBODIMENTS to FIG. 1, the travelling excavator shown therein includes a chassis or undercarriage 2 carrying a forwardly projecting frame 3 which can be adjusted in height by a plurality of hydraulic cylinders 1 attached to chassis 2. At the front end of frame 3, four excavating bucket wheels 6 (only one visible) are mounted for rotation on a common horizontal shaft 5 having an axis constituting the rotary axis 5' of each bucket wheel 6. Between the two outermost bucket wheels on the one hand, and a respective adjoining inner bucket wheel, on the other hand, a small space is provided to accommodate a forked part of the frame 3 for supporting the bucket wheels. The travelling excavator advances on a self-cut floor 7 against grown material 8 (for example, coal) to be removed, and dumps the excavated material (which has been removed by an upward cut) into a chute 9 supported on the frame 3 adjacent the periphery of the bucket wheels 6. The material is transported from chute 9 by means of two transverse belt conveyors 10 onto an ascending conveyor belt 11 extending in the longitudinal direction of the travelling excavator. Forces generated during the cutting process are transferred to the ground 7 by a skid 12 adjustably fastened to the frame 3.

The bucket wheels 6 are provided with circumferentially uniformly distributed buckets, each having at its outer edge a cutting plate 14 provided with a plurality of cutting teeth 13. The cutting plates 14 extend in the circumferential direction from cutting teeth 13 in a slightly inward inclination between two disc-shaped side walls 15 of bucket wheel 6 and are arranged in the zone of the outer periphery of the bucket wheel. The cutting plates 14 form one of the boundary walls of the respective bucket chambers. The number of buckets in each wheel (which in the illustrated embodiments is nine to eleven) depends primarily on the bucket wheel diameter or may be determined by requirements of particular use.

Figure 2:
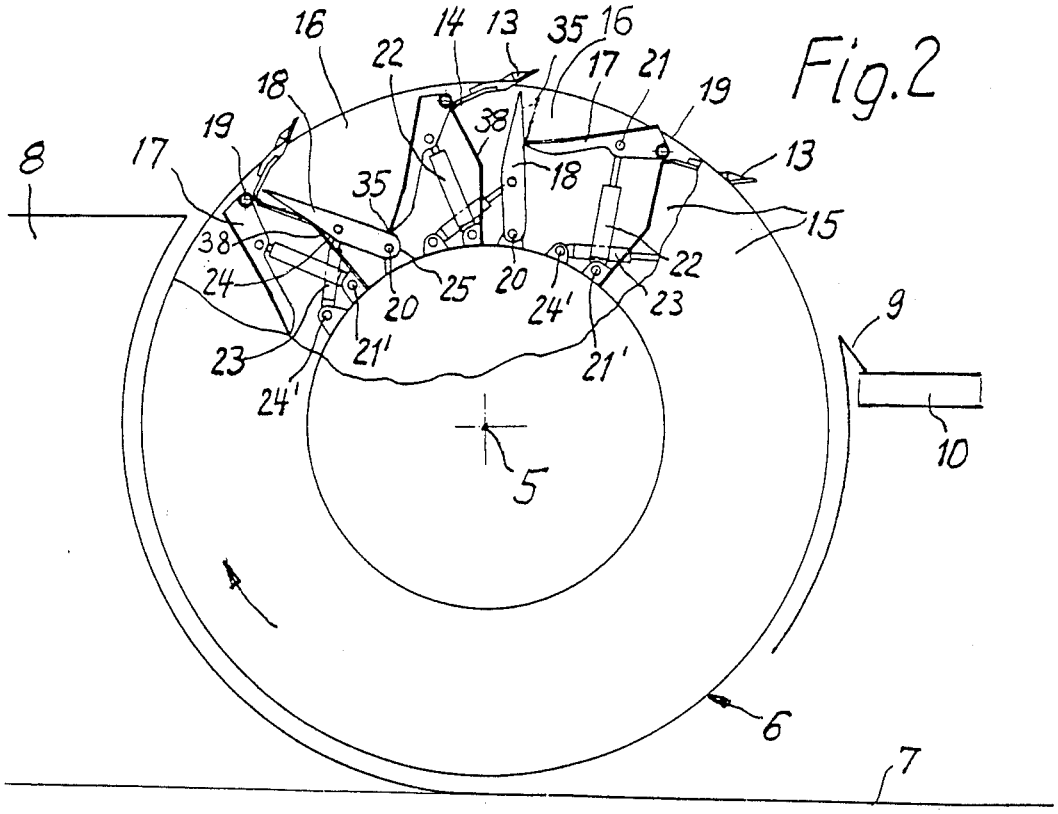

Turning to FIG. 2, chambers 16 are formed between the two lateral walls 15 in a radially outer zone of the bucket wheel. In addition to the cutting plate 14, each chamber 16 is bounded by a bottom wall 17 and a rear wall 18. Each bottom wall 17 is pivotal about a pivot shaft 19 supported, for example, in the side walls 15 and situated approximately at the outer circumference (outer periphery) of the bucket wheel 6 and at the trailing edge (as viewed in the direction of rotation) of the respective cutting plate 14. Each rear wall 18 is pivotal about a pivot shaft 20 at a radially innermost edge (related to the wheel axis 5) of the rear wall 18. The shafts 19 and 20 extend parallel to the rotary axis 5 of the bucket wheel 6.

The bottoms 17 are each movable by a separate hydraulic cylinder 22 articulated to the respective bottom 17 at 21, spaced from the respective pivot shaft 19. Likewise, the rear walls 18 are movable by separate hydraulic cylinders 23 which are articulated to the respective rear wall 18 at 24, spaced from the pivot shaft 20. The hydraulic cylinders 22 and 23 are each pivoted at their radially inner ends at respective support brackets 21' and 24' which, similarly to brackets for the pivot shafts 20 are secured on an annular wall 25 of the bucket wheel 6. By virtue of this arrangement, the pivotal points can be situated as far radially outwardly as possible to thus leave a central inner space free to accommodate other devices such as the bucket wheel drive, gearings or hydraulic fluid supply. The rightmost bucket chamber 16 illustrated in FIG. 2 is in a position in which the bottom wall 17 and the rear wall 18 are substantially in their outer end position which they assume shortly prior to the dumping position above the transverse conveyor belt 10. In the material-receiving position, on the other hand, the edge 35 of the bottom 17 engages the associated rear wall 18 at the lowest part thereof and the rear wall 18 itself is engaged by a stop member 38 which is affixed to the bucket wheel 6 and which is adapted to take up loads derived from the weight of material in that bucket chamber 16.

The control of the hydraulic cylinders 22, 23 is effected by known devices. Thus, in a simple manner, a cam disc may be provided which rotates synchronously with the bucket wheel 6 and which controls the admission of hydraulic fluid (or compressed air, in case pneumatic cylinders are used) in the appropriate power cylinders 22, 23. Such a control is described, for example, in U.S. Pat. No. 3,897,108. Preferably, double-acting cylinders 22 associated with the bottoms 17 are used. The hydraulic cylinders 23 associated with the rear walls 18 are expediently controlled such that at all times a sufficient pressure is maintained which ensures a continuous abutting relationship of the rear wall face with the trailing edge (as viewed in the direction of wheel rotation) of the respective bottom 17. It may be feasible to use, instead of individual, separate hydraulic cylinders 22 and 23, hydraulic cylinder units formed of a cylinder pair.

Figure 3:
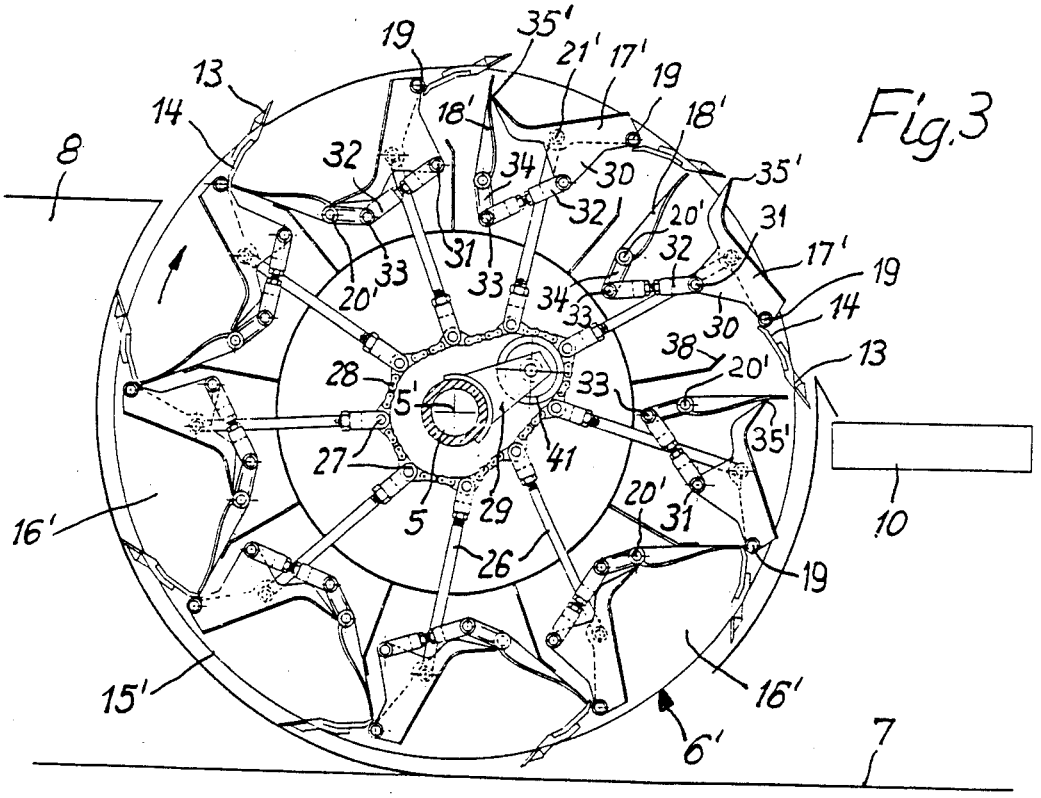
FIGS. 2, 3 and 4 are schematic side elevational views of three preferred embodiments of the invention.

Turning now to the embodiment illustrated in FIG. 3, instead of hydraulic cylinders characterizing the embodiment shown in FIG. 2, the drive mechanism (actuating mechanism) for the bottoms 17' comprises push rods 26 which, at their radially outer ends, are articulated to the bottoms 17' by pivots 21'. At their radially inner end the push rods 26 are articulated by pivots 27 to a circulating endless chain 28 at uniform distances along the chain length. The chain 28 is guided about an eccentric element which has a pivot arm 29 supported on the shaft 5 and carrying a guide pulley 41 about which the chain 28 is trained. The length of the chain 28 is so designed that at the major part of its length it runs in the central zone about the shaft 5 and sets itself to be substantially concentric with the rotary axis 5'. The guide pulley 41 is oriented, by virtue of the pivot arm 29, towards the zone in which the individual buckets are in the material-dumping position. Instead of the guide pulley 41 a sliding guide or sprocket wheel may be used. The angular position of the pivot arm 29 is adjustable. The rotation of the bucket wheel 6 causes the push rods 26—which have equal lengths but whose length can be individually adjusted—to move in a controlled manner as the chain 28 revolves.

Each bottom wall 17' has a projection 30, to the outer end of which a connecting member 32 is coupled by a joint 31. The connecting member 32 is connected at its other end with a joint 33 to a lever 34 which constitutes a generally coplanar prolongation of the rear wall 18' beyond the pivot shaft 20' thereof. The connecting member 32 and the lever 34, together with a part of the bottom 17' form the links of a quadrilateral joint assembly which has four articulations 19, 31, 33 and 20'. During a change of position of the bottom 17' (caused by the respective push rod 26) the quadrilateral joint assembly simultaneously causes the rear wall 18' to be pivoted such that the free outer edge 35' of the bottom 17' engages the rear wall 18' substantially throughout the duration of the outward pivotal (dumping) motion of the bottom 17'. In order to ensure such an engagement, the contour of each rear wall 18' is designed in accordance with a predetermined arcuate shape. The location of the articulations of the quadrilateral joint assembly is so designed that the axes of the articulations 19, 31 and 33 are, in the dumping position, approximately in a single plane as it may be observed in FIG. 3. It is also seen that in the bucket position immediately above the conveyor belt 10' the edge 35' of the bottom 17' has moved away from the rear wall 18' further outwardly to the zone of the tips of the cutting teeth 13. Further downstream (as viewed in the direction of rotation of the bucket wheel 6) the edge 35' of the respective bottom 17' has again arrived into engagement with the rear wall 18'. In all the other illustrated positions each bottom 17' and the associated rear wall 18' have assumed their other terminal position for receiving the material. In such a final position the edges 35' are situated in the zone of the articulation 20' for the respective rear wall 18'.

Figure 4:
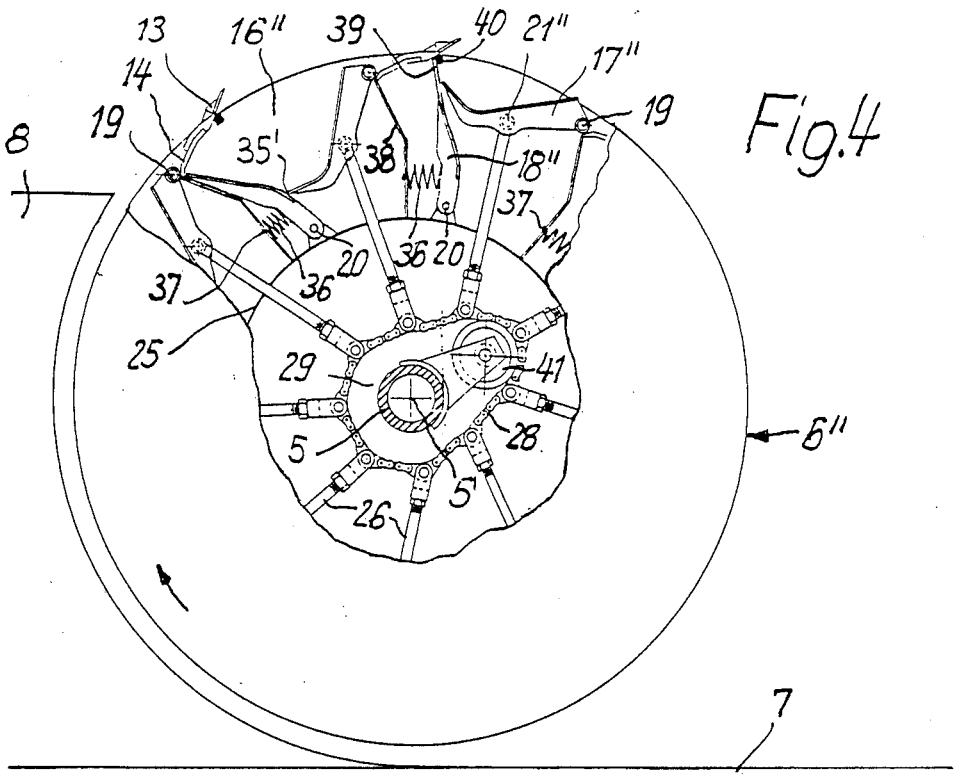

Turning now to the embodiment illustrated in FIG. 4, the bottom walls 17'', similarly to the precedingly described embodiment, are driven by push rods 26, and the rear walls 18'' swing about pivot shafts 20. Instead of driving the rear walls 18'' by a quadrilateral joint assembly (FIG. 3), however, the walls 18'' are moved in a simple manner by compression springs 36. Each compression spring 36 engages the inner side of the respective rear wall 18'' and is supported at 37 by the abutment 38 affixed to the bucket wheel 6. In the inner position, that is, in the material receiving state, the outer free edge 35' of the bottom 17'' holds the rear wall 18'' in position by the force of the spring 36. In this state the rear wall 18'', similarly to the earlier-described embodiments, firmly engages the abutment 38 to transmit thereto loads derived from the weight of the material in the bucket wheel. As the bottom wall 17'' rotates to assume its ejection (dumping) position, the rear wall 18'' remains in engagement with the edge 35' of the bottom 17'' by the force of the spring 36 until its free outer edge 39 of the rear wall 18'' arrives into engagement against a terminal abutment 40 situated at the inside of the respective cutting plate 14. Thereafter, the edge 35' of the bottom 17'' continues its outward movement similarly to the embodiment illustrated in FIG. 3.

In the embodiment of FIG. 4, the drive of the bottoms 17'' may be effected, instead of push rods 26, by hydraulic cylinders 22 similarly to the embodiment shown in FIG. 2. Also—by retaining the push rod drive—the compression spring elements 36 may be replaced by the hydraulic cylinders 23 of the FIG. 2 embodiment.

It will be understood that the above description of the present invention is susceptible to various modifications, changes and adaptations, and the same are intended to be comprehended within the meaning and range of equivalents of the appended claims.

What is claimed is:

1. In an excavating bucket wheel having a rotary axis; an outer periphery; a plurality of radially outwardly open bucket chambers disposed in a circular array about the rotary axis; during rotation of the bucket wheel each chamber assuming a material receiving position and a material dumping position circumferentially spaced along said periphery from said material receiving position; each bucket chamber being defined by a cutting plate supported at said periphery and having a trailing edge as viewed in the direction of rotation; two axially spaced, parallel side walls, a rear wall extending axially between the side walls; said rear wall having an inner edge and an outer edge; said inner edge being closer to the rotary axis than said outer edge; the outer edge being situated adjacent said cutting plate; and a bottom wall extending axially between the side walls and being supported for pivotal motion about an axis oriented parallel to said rotary axis of said bucket wheel and being situated adjacent said outer periphery; said bottom wall having a first pivotal position for receiving material and a second pivotal position for dumping material; said bottom wall further having an outer terminal edge; and first actuating means for pivoting said bottom wall; the improvement comprising pivot means for pivotally supporting each said rear wall, at the inner edge thereof, about an axis oriented parallel with the rotary axis of said bucket wheel; and second actuating means for urging each said rear wall into contact with the outer terminal edge of a respective said bottom wall.

2. An excavating bucket wheel as defined in claim 1, wherein said second actuating means comprises spring elements, each being in engagement with a separate said rear wall.

3. An excavating bucket wheel as defined in claim 1, wherein said second actuating means comprises fluid pressure cylinder units, each being in engagement with a separate said rear wall.

4. An excavating bucket wheel as defined in claim 1, further comprising abutments each cooperating with a separate said rear wall; each said rear wall being in an end position defined by an abutting engagement with a respective said abutment in said material receiving position.

5. An excavating bucket wheel as defined in claim 1, wherein said first actuating means comprises fluid pressure cylinder units, each being in engagement with a separate said bottom wall.

6. An excavating bucket wheel as defined in claim 1, further wherein each cutting plate has a zone located along said outer periphery; said outer terminal edge of each said bottom wall being situated at least as far from said rotary axis as said zone when said bottom wall is in said second pivotal position.

7. An excavating bucket wheel as defined in claim 1, further wherein each said cutting plate has cutting teeth situated in a zone radially beyond said outer periphery; said outer terminal edge of each said bottom wall being situated in said zone when said bottom wall is in said second pivotal position.

8. An excavating bucket wheel as defined in claim 1, further comprising a rotary shaft having an axis constituting said rotary axis; further wherein said first actuating means comprises an eccentric element mounted on said shaft and being radially offset relative to said axis of rotation; and transmission means cooperating with said eccentric element and with each said bottom wall for periodically and sequentially moving each said bottom wall into and out of the first and second pivotal positions during rotation of the excavating bucket wheel.

9. An excavating bucket wheel as defined in claim 8, wherein said transmission means comprises an endless chain trained about said eccentric element and passing around said rotary axis; and push rods of equal length; each said push rod having a first end articulated to a separate said bottom wall and a second end articulated to said endless chain; said push rods being articulated to said endless chain at uniform distances.

10. An excavating bucket wheel as defined in claim 1, wherein said second actuating means comprises linkage assemblies each articulated to a separate said bottom wall and a respective said rear wall for pivoting the rear walls upon motions of respective said bottom walls, effected by said first actuating means.

11. An excavating bucket wheel as defined in claim 10, wherein each said linkage assembly includes a lever having an end affixed to a respective said rear wall at the inner edge thereof, and a connecting member articulated to another end of said lever with a first axis of articulation and to a respective said bottom wall with a second axis of articulation.

12. An excavating bucket wheel as defined in claim 11, wherein said lever extending away from the rear wall generally as a coplanar continuation thereof; further wherein said first and second axes of articulation and said axis about which the bottom wall is pivotal lie substantially in a common plane when said bottom wall is in said second pivotal position.

* * * * *